US006651915B2

(12) United States Patent
Staudenrausch

(10) Patent No.: US 6,651,915 B2
(45) Date of Patent: Nov. 25, 2003

(54) MINCING DISC AND MEAT MACHINE COMPRISING A MINCING DISC

(75) Inventor: Georg Staudenrausch, Biberach/Rissegg (DE)

(73) Assignee: Albert Handtmann Maschinenfabrik, Biberach (DE)

( * ) Notice: Subject to any disclaimer, the term of this patent is extended or adjusted under 35 U.S.C. 154(b) by 0 days.

(21) Appl. No.: 10/057,373

(22) Filed: Jan. 25, 2002

(65) Prior Publication Data

US 2002/0100826 A1 Aug. 1, 2002

(30) Foreign Application Priority Data

Jan. 26, 2001 (DE) ..... 201 01 396

(51) Int. Cl.[7] ..... B02C 18/36
(52) U.S. Cl. ..... 241/82.5; 241/296
(58) Field of Search ..... 241/82.1–82.7, 241/296

(56) References Cited

U.S. PATENT DOCUMENTS 2,967,555 A * 1/1961 Baker ..... 241/82.5
5,765,768 A * 6/1998 Gagliardi ..... 241/82.6

FOREIGN PATENT DOCUMENTS

DE 277399 4/1990
FR 921353 5/1947

* cited by examiner

*Primary Examiner*—Mark Rosenbaum
(74) *Attorney, Agent, or Firm*—Marshall, Gerstein & Borun LLP

(57) ABSTRACT

A mincing disc used in a meat mincing machine having partial areas in a field of perforations of the mincing disc which are arrange in an imagined corridor at both sides of the central through opening which extends over the surface of the mincing disc, encloses the central through opening of the disc, and touches the ventral through opening with both linear boundary lines.

10 Claims, 1 Drawing Sheet

MINCING DISC AND MEAT MACHINE COMPRISING A MINCING DISC

FIELD OF THE INVENTION

The invention relates to a meat mincing machine comprising a mincing disc as well as to a mincing disc for producing continuous coils of minced meat substantially having a rectangular cross-section.

BACKGROUND OF THE INVENTION

What is known is a meat mincing machine comprising a mincing disc with a field of perforations disposed in an annulus about a central through opening for a shaft. The continuous coil of minced meat discharged from the meat mincing machine when such a mincing disc is employed has a substantially annular cross-section. For packaging the minced meat in portion trays it is, however, advantageous if a continuous coil of minced meat has a substantially rectangular or trapezoidal cross-section. For this purpose the meat mincing machine is in general subsequently equipped with a filling mincer which serves to fill in the minced meat so as to form a continuous coil of minced meat with, for instance, a rectangular shape. In this case the filling mincer comprises a mincing disc with a field of perforations having a rectangular shape.

Typically the filling mincer has to be charged with minced meat which has already been subjected to final granulation. The fact that the field of perforations is rectangular on one hand whereas only limited space is available on the disc surface of the mincing disc on the other hand, provides only for a limited surface area for the discharge of the minced meat, which results in that a major part of the minced meat is only pushed against the mincing disc of the filling mincer and is pressed, as it cannot exit through the mincing disc due to a lack of discharge holes provided on the relatively small rectangular field of perforations. In the portions of the mincing disc with no opening the minced meat therefore undergoes a reduction of quality, especially if it was not finally granulated in advance to a large extent.

Furthermore, the efficiency of such a filling mincer is relatively small as merely a small surface of the mincing disc is used for producing a continuous coil of minced meat. Also the width of a continuous coil of minced meat to be produced is limited as only a rectangle can be fitted in between the outer periphery of the mincing disc and the central through opening for a shaft, which does not have the full Width of the mincing disc.

SUMMARY OF THE INVENTION

It is, therefore, the object of the present invention to provide a meat mincing machine comprising a mincing disc as well as a mincing disc, which permits the production of a continuous coil of minced meat with a substantially rectangular cross-section by using a possibly large portion of the mincing disc and which, moreover, produces a continuous coil of minced meat whereof the width may even be larger than the width of the mincing disc.

The above-described object is provided by a mincing disc according to the features of claim 1.

The mincing disc according to the invention is accordingly provided with a field of perforations having partial areas arranged in an imagined corridor provided at both sides of the central through opening which extends over the surface of the mincing disc, encloses the central through opening and touches the central through opening with both linear boundary lines.

Starting out from a rectangle, which, according to FIG. 2 (FIG. 2 shows a mincing disc according to the invention), is, for instance, fitted in underneath line 13*a* between the central through opening 8 and the periphery of the disc, the field of perforations in a mincing disc according to the invention is, for example, extended upwardly at both sides of the central through opening. This results in a portion of the field of perforations at opposite sides of the central through opening, whereby the used surface of the mincing disc becomes larger. In other words, the field of perforations is, for instance, enclosed by a boundary line having a curved portion.

Such a field of perforations permits the use of a larger portion of the mincing disc and, thus, the production of a continuous coil of minced meat with a substantially rectangular cross-section compared to a mincing disc where a rectangle is fitted in between the periphery and the central through opening.

If the continuous coil of minced meat, upon its discharge from the mincing disc, drops onto a deposit place, the continuous coil of minced meat may undergo deformation such that a continuous coil of minced meat with a substantially rectangular cross-section is produced, namely due to the folding of the continuous coil of minced meat or, respectively, due to the adjustment thereof to the plane deposit.

This entails the advantage that a larger portion of the mincing disc can be used. Moreover, pre-chopping by means of a preceding meat mincing machine is not necessary, as relatively large portions of the mincing disc are provided with a field of perforations, so that also the ejection pressure becomes lower altogether, which, again, results in a smoother treatment of the minced meat. Furthermore, it becomes possible to have the minced meat finally granulated in the filling mincer itself without requiring a preceding final mincer.

The lateral arrangement of the portions of the field of perforations at both sides of the central opening results altogether also in widening the continuous coil to be produced. If, for instance, the portions of the field of perforations with a bent lower boundary line are arranged horizontally and laterally at both sides of the central opening, the continuous coil of minced meat discharged from the mincing disc, when placed on the following deposit, can laterally fold down from its discharge shape with pulled up sides, in other words, the sides, too, are wound off on the deposit and result in a larger width of the continuous coil of minced meat compared to the width of the mincing disc.

The field of perforations is favorably U-shaped. The term U-shaped hereby also includes an approximately half-circle annular shape which does not exactly show two straight legs extending in parallel. Such a shape especially serves to produce a continuous coil of minced meat which is as wide as possible, as upon the folding of the continuous coil of minced meat on the deposit after its discharge from the mincingly disc a continuous coil of minced meat having a width and a substantially rectangular cross-section is provided, whereby the width of the continuous coil exceeds the diameter of the mincing disc. This is especially favorable as continuous coils of minced meat having a large width can likewise be produced with small meat mincing machines.

Moreover advantageous is an embodiment according to the invention where the field of perforations completely encloses the central through opening thereby permitting an additional enlargement of the surface of the mincing disc which is required for producing the continuous coil of minced meat with a substantially rectangular cross-section.

The field of perforations preferably comprises at least one linear boundary line. By one or more of such linear boundary lines a most favorable adjustment of the cross-section of the continuous coil of minced meat to a rectangular shape can be achieved.

Another advantageous embodiment of the invention resides in that a part of the field of perforations is arranged above and another part of the field of perforations underneath the central through opening. It is, moreover, an advantage if a part of the field of perforations is arranged at the right-hand side of the central through opening and another part at the left-hand side thereof. By means of said two steps the usable portion of the mincing disc for producing a continuous coil of minced meat having a substantially rectangular cross-section can be increased.

An advantageous embodiment of the invention furthermore resides in that the field of perforations is arranged mirror-symmetrically to at least one mirror axis extending through the center of the disc periphery. The symmetrical arrangement of the field of perforations to at least one mirror axis also results in a symmetrically formed continuous coil of minced meat, which is an advantage for the filling and portioning of the minced meat.

Another advantageous embodiment of the invention resides in that the field of perforations includes at least one portion of more than 30% of the entire surface of the discharge opening of the mincer. The fact that a surface of more than 30% of the entire surface of the discharge opening of the mincer is used for producing the continuous coil of minced meat with a substantially rectangular cross-section renders the mincer highly efficient, and only a small amount of meat or minced meat, respectively, is exposed to a quality reducing pressure. Mincing discs for producing rectangular continuous coils of minced meat according to the prior art merely exploit a surface of approximately 20% of the entire surface of the discharge opening of the mincer.

BRIEF DESCRIPTION OF THE DRAWINGS

An embodiment of the machine according to the invention will hereinafter be explained by means of the attached figures, wherein.

DETAILED DESCRIPTION OF INVENTION

Figure 1:
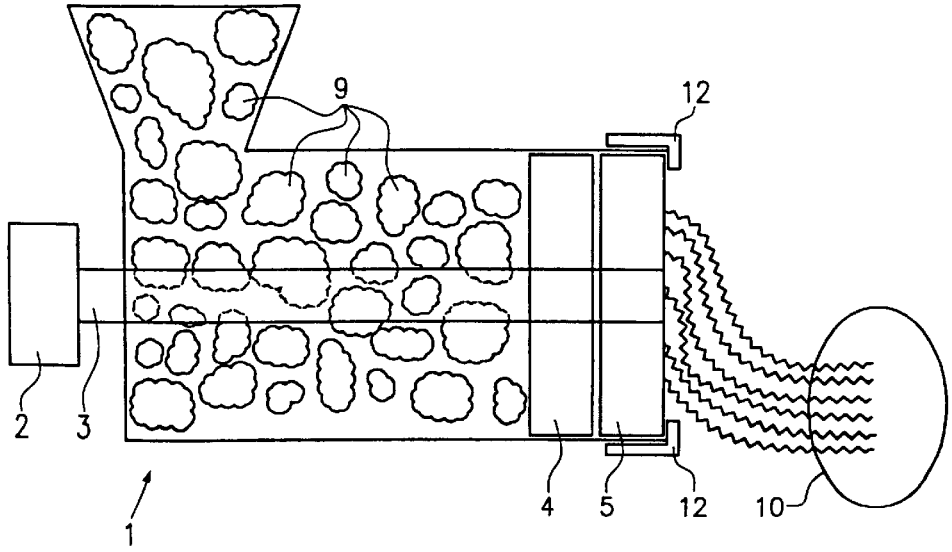
FIG. 1 shows a schematic drawing of a meat mincing machine

FIG. 1 illustrates a meat mincing machine used for the production of minced meat. A motor 2 drives a shaft 3 which rotates a knife 4. The blades of the knife 4 are disposed in the direction of the mincing disc 5. The meat 9 is, for instance, filled in through a funnel at the top and is granulated to result in pre-selected granulation by the blades disposed on the knife 4 and by the holes 7 provided in the mincing disc 5. The mincing disc 5 is fixed to the meat mincing machine, for instance, by a swivel nut 12. Furthermore, the mincing disc is secured against rotation by a corresponding device, for example, by a groove 11 in the disc. In the portion filled with pieces of meat 9 inside the meat mincing machine a transport device may optionally also be provided, for instance, in form of a worn, which transports the meat 9 in the direction of the knife 4 and the mincing disc 5. A continuous coil of minced meat 10 is discharged from the meat mincing machine 1.

Figure 2:
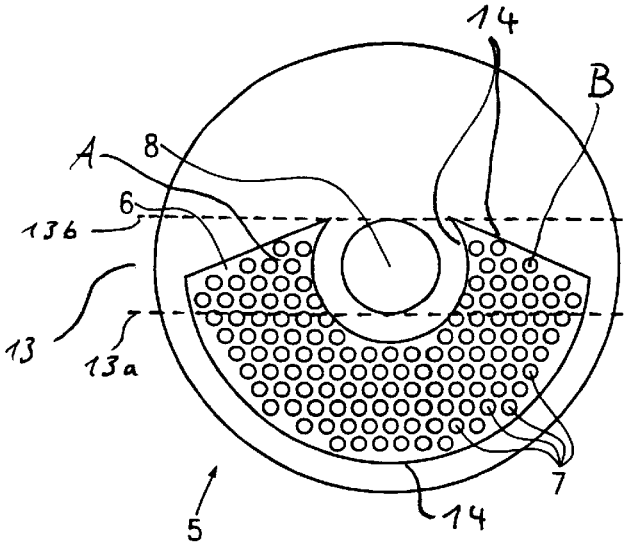
FIG. 2 shows a mincing disc with a U-shaped field of perforations

FIG. 2 shows a mincing disc according to the invention or, respectively, a mincing disc of the meal mincing machine according to the invention. The imagined corridor 13 is defined by two linear boundary lines 13*a* and 13*b*. Holes 7 are arranged within the boundary line 14 of a U-shaped field of perforations 6. Even if the corridor 13 according to FIG. 2 is shown to extend symmetrically to the vertical line, asymmetrical solutions are likewise conceivable, i.e. the corridor may extend over the disc surface in a tilted fashion or may even be vertical. The holes 7 in the partial areas A and B are disposed, in accordance with the invention, at both sides of the central through opening 8 and in the corridor 13.

The continuous coil of minced meat discharged from the mincing disc in a U-shape subsequently drops onto a deposit where the U-shape unfolds so that a continuous coil of minced meat having a substantially rectangular cross-section is formed. The two linear ends of the field of perforations 6 at the top may also be arranged further up in the mincing disc or, respectively, further down in the mincing disc. Such a U-shaped arrangement of the field of perforations produces a continuous coil of minced meat whereof the final width is larger than the diameter of the mincing disc.

Figure 3:
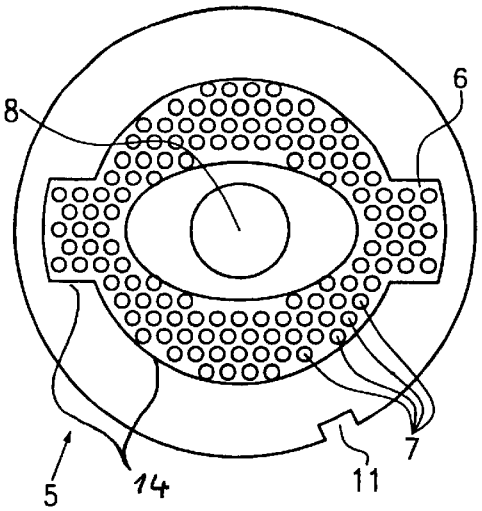
FIG. 3 shows a mincing disc with a field of perforations enclosing the central through opening.

FIG. 3 shows another embodiment of the mincing disc according to the invention or, respectively, of a mincing disc provided in the machine according to the invention. For producing a continuous coil of minced meat with a substantially rectangular cross-section the field of perforations 6 extends about the central trough opening 8. In accordance with the invention, however, only a part of the surface of the mincing disc 5 available for the field of perforations is used for filling a continuous coil of minced meat 10. The eye-shaped construction of the field of perforations 6 in the central portion of the disc about the central through opening 8 forms a continuous coil of minced meat, which, after being discharged from the meat mincing machine 1, is folded on a deposit so as to form a substantially rectangular cross-section. The opening formed in the continuous coil of minced meat by the eye-shaped recess in the field of perforations 6 about the central through opening 8 is closed after the continuous coil of minced meat is discharged from the meat mincing machine.

I claim:

1. Mincing disc used in a meat mincing machine (1) for the production of continuous coils of minced meat (10) having a substantially rectangular cross-section, comprising in combination a mincing disc member (5) having a central through opening (8) for passing a shaft (3) therethrough, and a field of perforations (6) provided only on a partial area of the front face of said mincing disc member (5) available for said field of perforations (6); said field of perforations (6) being formed of a plurality of partial areas (A, B) in said field of perforations (6) arranged in an imagined corridor (13) at both sides of said central through opening (8) which extends over the surface of said mincing disc member (5) encloses said central through opening (8) and touches said central through opening (8) with both linear boundary lines (13*a*, 13*b*).

2. Mincing disc according to claim 1, wherein said field of perforations (6) is generally U-shaped.

3. Mincing disc according to claim 1, wherein said field of perforations (6) completely encloses said central through opening (8).

4. Mincing disc according to claim 1, wherein said field of perforations (6) has at least one generally U-shaped boundary line (14).

5. Mincing disc according to claim 1, wherein a part of said field of perforations (6) is arranged above and another part of said field of perforations (6) is arranged underneath said central through opening (8).

6. Mincing disc according to claim 1, wherein one of the plurality of partial areas (B) of said field of perforations (6) is arranged at the right-hand side and another of the plurality of partial areas (A) of said field of perforations (6) is arranged at the left-hand side of said through opening (8).

7. Mincing disc according to claim 1, wherein said field of perforations (6) is disposed mirror-symmetrically to at least one mirror axis extending through the center of the disc periphery.

8. Mincing disc according to claim 1 in combination with a meat mincing machine, said meat mincing machine (1) having a discharge opening, wherein said field of perforations (6) includes at least a portion of more than 30% of the entire surface of said discharge opening of said meat mincing machine (1).

9. Mincing disc according to claim 1 in combination with a meat mincing machine, and said meat mincing machine (1) having a discharge opening.

10. Mincing disc and meat mincing machine combination according to claim 9, and at least one additional mincing disc member (5) mounted to said meat mincing machine (1).

* * * * *

UNITED STATES PATENT AND TRADEMARK OFFICE

CERTIFICATE OF CORRECTION

PATENT NO. : 6,651,915 B2
DATED : November 25, 2003
INVENTOR(S) : Georg Staudenrausch It is certified that error appears in the above-identified patent and that said Letters Patent is hereby corrected as shown below:

Title page,
Item [73], Assignee, please change to -- Albert Handtmann Maschinenfabrik GmbH & Co. KG --

Signed and Sealed this

Sixth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,651,915 B2
DATED : November 25, 2003
INVENTOR(S) : Georg Staudenrausch It is certified that error appears in the above-identified patent and that said Letters Patent is hereby corrected as shown below:

Title page,
Item [57], ABSTRACT,
Line 3, replace “arrange” with -- arranged --

Signed and Sealed this

Eighth Day of June, 2004

JON W. DUDAS
*Acting Director of the United States Patent and Trademark Office*